US005955171A

United States Patent [19]

Lujan

[11] Patent Number: 5,955,171

[45] Date of Patent: Sep. 21, 1999

[54] PROCEDURE FOR MAKING HIGHLY RESISTANT STRUCTURES, WITH ABILITY TO ABSORB ENERGY BY THE INTERLINKING OF LAYERS FORMED WITH LONGITUDINAL HELICAL METAL STRIPS AND STRUCTURES OBTAINED THEREFROM

[76] Inventor: Dardo Bonaparte Lujan, Castelli 2234, Mar del Plata, Provincia de Buenos Aires, Argentina

[21] Appl. No.: 09/074,777

[22] Filed: May 8, 1998

[30] Foreign Application Priority Data

May 9, 1997 [AR] Argentina ..... 97 01 01959

[51] Int. Cl.[6] ..... F16F 3/04; B32B 5/00

[52] U.S. Cl. ..... 428/98; 428/113; 428/332; 428/592; 267/92; 267/182

[58] Field of Search ..... 428/592, 98, 113, 428/332; 267/92, 182

[56] References Cited

U.S. PATENT DOCUMENTS 3,649,000 3/1972 Desy ..... 267/179

*Primary Examiner*—Richard Weisberger

*Attorney, Agent, or Firm*—Collen Law Associates, P.C.

[57] ABSTRACT

Described is a particular procedure to make structures from longitudinal helical metal strips, the same are adecuate to conform different objects, such as plates, planks, sheets, tubes, shafts, etc. and they are porous, flexible, highly resistant and with great ability to absorb the different applications to which they may be subjected, i.e. mechanical, caloric, sound, etc. The procedure consists in stinging the entangled metal strips, each metal strip with its adyacent, until "layers" are formed, and these, in turn, are entangled to each other until a structure is formed, which gaps determining the porosity will be at least the same size than the thickness of the filament constituting the metal strip. The layers may be formed by metal strips made of any type of material (metallic, synthetic, etc.) and they may be combined among them. The invention describes a mathematical calculation that allows to determine the behavior of the structure obtained once the material and thickness, as well as the diameter and the pitch of the respective helical coils, is determined.

19 Claims, 6 Drawing Sheets

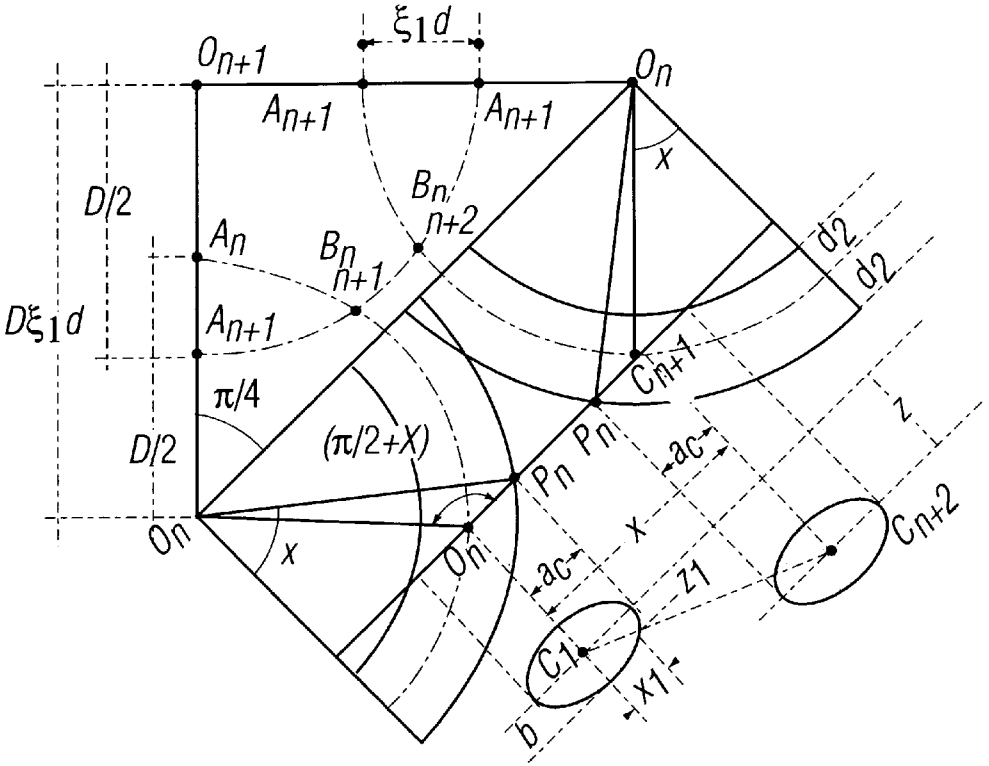
Fig. 5
Fig. 3
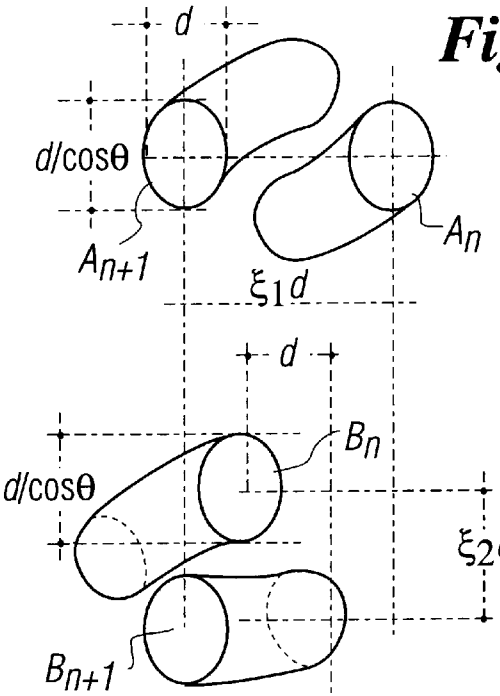
Fig. 4

PARAMETER A CORRESPONDING TO MINIMUM WEIGHT

| $\xi$ = with form 16:Amin | = 0.70 = 0.690 | = 0.80 = 0.681 | = 1.00 = 0.653 | = 1.20 = 0.635 | = 1.40 = 0.621 | = 1.60 = 0.613 | = 1.80 = 0.606 | = 2.00 = 0.600 |
|---|---|---|---|---|---|---|---|---|
| Amin ► | 3.0195 | 3.3638 | 4.0902 | 4.8349 | 5.5937 | 6.3577 | 7.3476 | 7.9063 |
| = 0.700 ► | 3.0121 | 3.3504 | 4.0486 | 4.7650 | 5.4925 | 6.2276 | 6.9668 | 7.7099 |
| = 0.750 ► | 3.0100 | 3.3600 | 4.0792 | 4.8145 | 5.5595 | 6.3108 | 7.10663 | 7.8248 |
| = 0.800 ► | 3.0807 | 3.4303 | 4.2123 | 4.9862 | 5.7686 | 6.5563 | 7.3476 | 8.1415 |
| = 0.850 ► | 3.2658 | 3.6751 | 4.5083 | 5.3534 | 6.2055 | 7.0621 | 7.9217 | 8.7834 |

$$f(A) = \xi/A\sqrt{1 + \left(\frac{\text{arcs } A}{1 - A}\right)^2 \xi^2}$$

(form 22)

*Fig. 7*

SPACE OF EXISTENCE OF THE MESH (with the minimum weight of A)

PROCEDURE FOR MAKING HIGHLY RESISTANT STRUCTURES, WITH ABILITY TO ABSORB ENERGY BY THE INTERLINKING OF LAYERS FORMED WITH LONGITUDINAL HELICAL METAL STRIPS AND STRUCTURES OBTAINED THEREFROM

The main purpose of the present invention is to provide a procedure for making a highly resistant structure with ability to absorb energy from the interconnection of layers made up with long helical metal metal strips and various structures obtained from said procedure, which stand out from every physical structure known at present by reason of having high porosity, high mechanical strength and great ability to absorb energy.

With the invented procedure, it is possible to obtain structures including the above mentioned features, and to conform estructural systems from which several bodies are defined, i.e. tubes, plates, planks, cables, axles, sheets for insulation and protection liners, or otherwise any body requiring a highly resistant, light and flexible structure.

SUMMARY OF THE INVENTION

The present invention refers to a very novel industrial procedure based on the interliking of helical metal strips which as a whole form a particular web, the gaps of which provide the ability of being flexible as well as highly resistant to torsion, bending and tension strengths, while being at the same time light.

They are helical metal strips which, upon determining the purpose and capacity of the structure they will constitute, they are stringed one to the other, through an advance in longitudinal direction, with a simultaneous rotary movement, thereby entangling all the metal strips to each other. Once the thickness of the filament which constitutes each helical metal strip, as well as the diameter of the helicoid and the mutual separation among them are known, it is possible through this procedure to string so many metal strips to each other until conforming a structure composed of multiple helical metal strips, and said web determines a plurality of gaps, all of which are identical to each other, obtaining a highly resistant and porous structure having features different from those of any other solid structure known at present, specially regarding its estructural capacity-to-weight ratio.

In this respect, experimental tests have demonstrated a higher performance in the body constituted according to the procedure of this invention, than that of others known so far, which are solid and are either metallic or which consist of compositions including entangled fibers. In effect, when the known structures are very resistent, they loose bending and porosity conditions, or their weight is too high; on the contrary, when they are flexible they loose mechanical strength for other applications.

In effect, the novel manner of constructing a structure through the procedure of the present invention, enables said structure to behave in different ways according to the requirements sought based on the use to be given to the same. This behaviour will not only be related to the material constituing the filament of each helical metal strip, which may be made of steel, titanium, aluminium, brass, synthetic or natural fibers, composite materials, etc., but also to the web resulting from the entaglement of the helical metal strips making up the same.

The main feature of the structure obtained as stated above, refers to its capacity to absorb, diffuse and transform any type of stress. This is due to the fact that the multiple gaps have curved walls which behaviour is different from that of flat walls.

MAIN PURPOSE

The main purpose of this invention is a procedure to obtain structures formed by the entanglement of adyacent helical metal strips which determine layers, which are linked one to the other through the entanglement of their respective constituting helical metal strips.

For the purpose of said entanglement, each metal strip is incorporated by means of the above mentioned forward longitudinal movement of advance, simultaneously rotating about its own axle, penetrating into the aligned gaps present in the structure thus being formed.

Consequently, the first stage of the process invented is to determine and select the longitudinal filament, the constitutive material of which depends on the application to be given to the structure. The second stage consists in winding the selected filament, placing it on adequate supports or means, according to the constitutive material thereof and its size. The third stage consists in conforming, with said filament, helical metal strips which lengths, filament thickness, space between each helicoid "pitch", diameter of each helicoid, as well as the conformation of each helicoid, (circumferential, ellipsoidal or polygonal), will determine the physical behaviour of the structure to be constituted.

Once the helical metal strips are conformed, the invented procedure includes the stage of entangling the metal strips one to the other, and for that purpose, two types of simultaneous movements are made in every case, ss: a) a forward movement of advance, in the longitudinal direction and b) another one of rotation in circumferential direction about the longitudinal axle of said metal strip, being this movement clockwise equal and opposed (SIC). For this forward movement of advance of entanglement, one metal strip is moved at a time respect to those with which it will be linked, which remain static and receptive. The action consists in that with this rotating advances, the internal space of the helicoids belonging to the metal strips which remain static and receptive is traversed, thus, each helical coil of the metal strip inserted gets entangled with those of said static and receptive metal strips.

It is expressly stated that the invention contemplates that a metal strip may be entangled to another which remains static and receptive, as well as the fact that this occurs on a simultanous basis to two or more metal strips which remain static and receptive; this mainly depends on the desired conditions and mechanical characteristics to be given to the structure. When the structure obtained results from the entanglement of numerous helical metal strips to each other, its particular conformation will have great influence in the performance thereof, coadjuvanting with its constitutive material. It is in these cases when the structure acquires the novel functional characteristics, and its great ability to stand the different mechanical stresses while keeping the features of flexibility and porosity. Obviously, the higher the number of metal strips entangled to each other, which is used per volume unit, the higher the stiffness of the structure and the gaps or the pores which are conformed are smaller in size. The conformation limit is determined when the size of the gaps is smaller than the thickness of the metal strips forming the same.

On the other hand, if a very flexible and highly porous structure is needed, the gaps arising from the entanglement of the helical metal strips will be greater in size.

During this stage of metal strips entanglement, the thickness and all the other dimensions and formats of the structure, such as length, width, perimetral conformation, etc., are also determined.

It is expressly stated that the helical metal strips may be conformed by means of dies, in which case every type of composite materials which adapts to the purpose or application intended for the structure (e.g. carbon, boron, etc.) may be used.

It is also stressed that the conformation of the structure with the procedure of the invention, may comprise several "layers" joined to each other through the very helical metal strips forming the same. A first layer will be that determined by the entanglement of metal strips, parallel to each other in the same horizontal plane. The second "layer" will be that determined by other metal strips which, further to a mutal entanglement, they are entangled to the metal strips of the previous layer and at this point the following different construction options arise: a) That said entanglement action of the metal strips of the second layer, will be carried out in the same direction than that used to form the previous layer; thus, each metal strip of this second "layer" will be parallel to those of the first "layer" and it will be entangled to at least one metal strip of said first layer and to another one adyacent of the second layer, b) That the metal strips of the second layer will be transversely oriented in respect to those of the first layer entangled to each other; c) that the metal strips of the second "layer" follow a skewed direction respect to those of the first "layer", keeping the reciprocal entanglement wherein each metal strip of the second "layer", besides being linked to at least one of its adyacent metal strips, will be linked to several ones in the following layer.

According to the statements of the previous paragraphs, it is concluded that the same structure may comprise several "layers" interlinked to each other in the manners specified, leaving internal spans having different ways of being linked, or else being empty, and also it may include spans formed by "layers" of different configuration, interposed in the structure body, which metal strips are not interlinked to each other.

The procedure invented contemplates that, depending on the final conformations required, the interposition of helical metal strips which are entangled to each other, may follow vertical, horizontal and skewed forward movements of advance.

Bearing in mind what was revealed so far, it is expected that, upon knowing the purpose for which the structure will be used, the manufacturer must first select the constitutive material with which the structure will be made, then he must determine the gauge or thickness of the filament with which the helical metal strip will be made, thus determining the conformation of its helical coils, its pitch, inner diameter, the relative inclination of the longitudinal axles used by the metal strips of each layer, the amount of helicoids which will be entangled by each helicoid of each metal strip. Evidently, based on the operational principle which defines the procedure of the present patent of invention, a wide span of different options appears, since even though it is a simple method in appearance, it requires high technology, which in some cases demands extremely complex mathematical calculations in order to determine the tangential and vertical forces to which the structure will be subjected.

Naturally, once the manner in which the entanglement of helicoids is known, their distribution to determine the different layers and the linking of the same with their adyacents, the devices and machines capable of carrying out said structural conformation may be designed; said devices and machines may vary based on the material to be used or else on the size of the structure to be formed and on the format thereof. For example, there will be sheets or plates of great size designed for the lining of special buildings, as well as light sheets with low gauge, made with semiconductive materials to line surfaces exposed to radiation.

Having described the process of the invention, manufacturing criteria are detailed hereunder to carry out the same:

1) It must be determined which is the product or application required.

2) Once the product or applications has been determined, it must be specified the type of filament to be used (steel, titanium, copper, fibres, etc.) taking into account their stiffness and elasticity.

3) Just then, the diameter of the filament to be applied must be determined.

4) Once the diameter of the filament and the type of material has been determined, the formula of the respective parameters to achieve a structure shall be applied, said structure may be layered, macroporous, flexible or stiff, light or semiheavy, in sheets or honeycomb like, round or in tube, etc., with big or small gaps, in order to make just then the respective helicoids.

5) Once the helicoid to be applied is determined, they are stringed to each other in a coplanar basis, clearly determining whether they adopt a parallel, diagonal or cross conformation, pursuant to the desired technical result or product to be achieved, thus obtaining a novel industrial product.

DETAILED DESCRIPTION OF A PARAMETRICAL ANALISIS TO DETERMINE THE CONFIGURATION OF A SPECIFIED STRUCTURE.

A parametrical analysis, supported by drawings, charts and diagrams, from which it is possible to determine the configuration of a specified structure, is detailed hereunder in order to clarify the advantages briefly commented heretofore, and to which users and persons skilled in the art may add many others, and in order to demonstrate that the procedure invented may be put into practice.

FIGS. 3 and 4 are details showing helicoid sections with reference to dimensions.

The charts and graphics No. 5, 6, 7 and 8 are used for the same calculation detailed hereunder.

Figure 1:
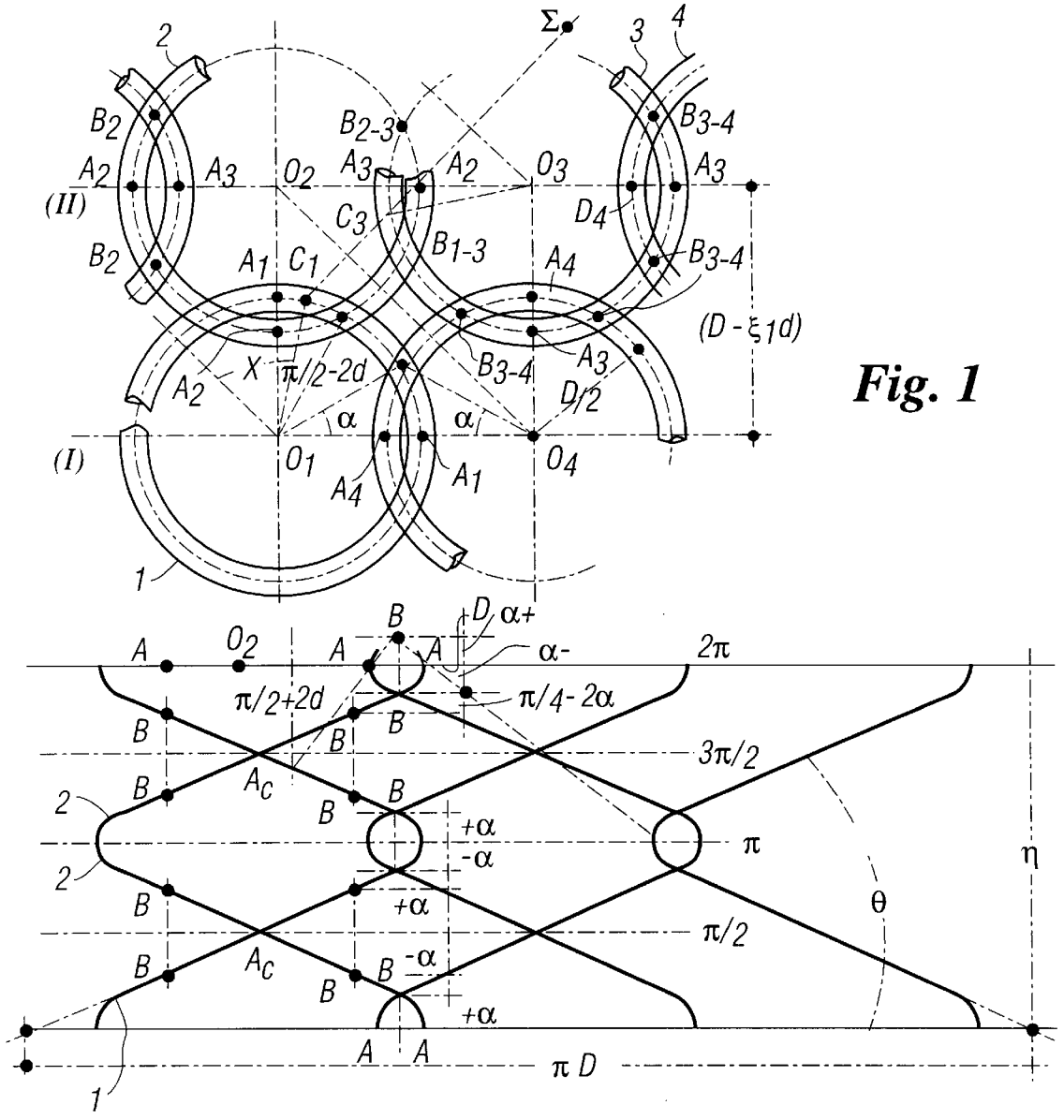
FIG. 1 shows a graphic, schematically representing spans of five helicoids which are entangled with parametric auxiliary indications which allow the calculation described hereunder.

To determine the capacity of absorbing the mechanical stress on webs made as per the steel wire mesh proposed (FIG. 1), it is convenient to previously determine the weight and geometrical feasibility conditions corresponding to each possible configuration, in order not to draw out solutions which, in practice, are not applicable or not very convenient.

Therefore, as in every project in which optimization is required, the "parametric space of existence" of this design must be found, and to that effect two non-dimensional parameters are defined:

$$\delta=(d/D)\ \eta=tgB=(p/\pi D) \quad (1)$$

which are determined from the diameters of the wire (d) and from the helicoid axis (D) and from the pitch of the same helicoid (p).

Figure 2:
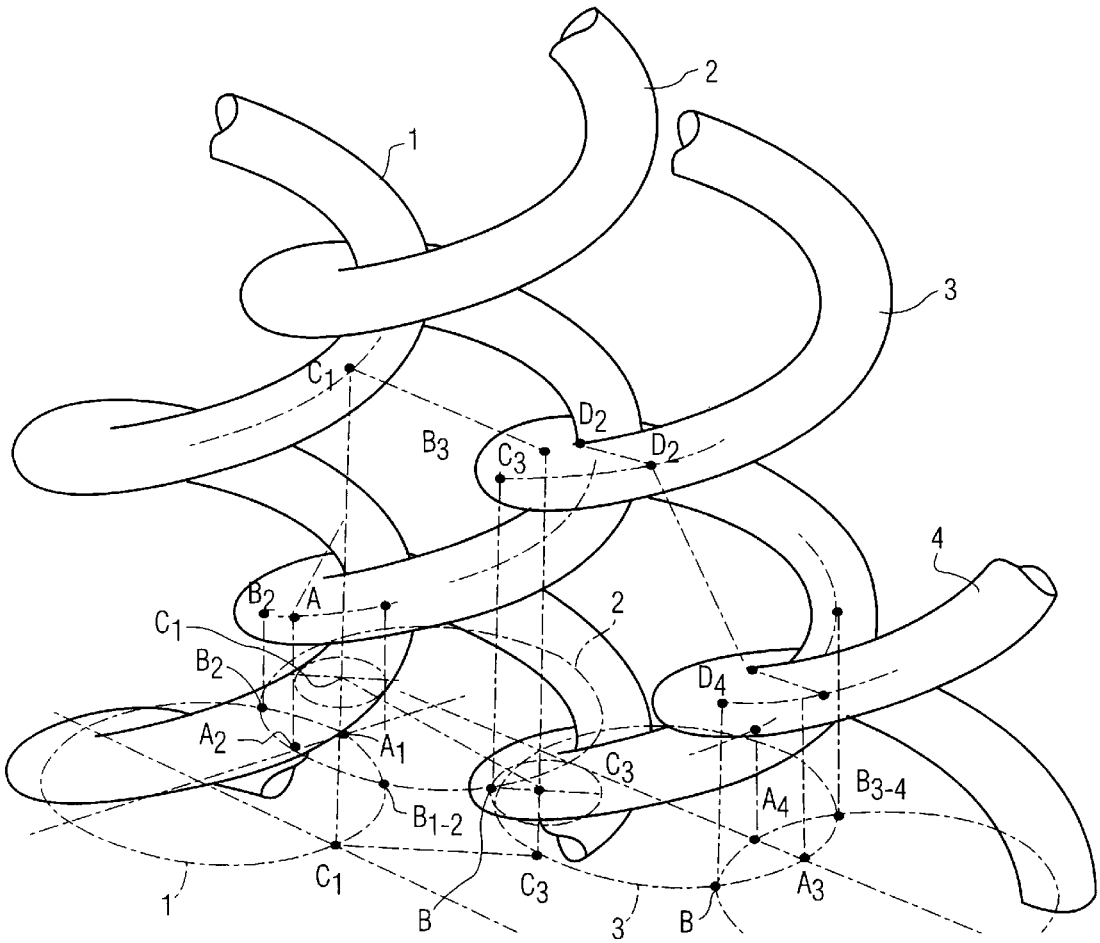
FIG. 2 shows a perspective view showing spans of four helical metal strips which are entangled with referential indications which are used for the above mentioned calculation.

FIG. 2 shows a perspective view, for a better understanding, of a mesh element, constituted by four helicoids 1, 2, 3 and 4, disposed over two layers: I(1) y II(2, 3 and 4); said element is enough to determine the critical locations of this design, i.e., the locations on which there could be a mutal penetration between the helicoids of the mesh. It is verified that such locations are determined considering segments $A_n$ $A_{n+1}$ (normal to the axis of the helicoids), $B_n$ $B_{n+1}$ (parallel to the axis of the helicoids), $C_n$ $C_{n+2}$ (warped respect to the axis) and $D_n$ $D_{n+2}$ (also warped). These four conditions of the mesh existence will be analyzed by separate:

a) POINTS $A_n$ $A_{n+1}$ (on two helicoids mutually linked as per FIG. 3). Plane $\Sigma_A$, which passes through axis $O_n$ $O_{n+1}$ of the two helicoids and through points $A_n$ $A_{n+1}$, determines two sections of the wires which may be considered elliptical, with centers $A_n$ $A_{n+1}$ and with its semiaxis normal to $O_n$ $O_{n+1}$, given by:

$$^aA=(d/2) \quad (2)$$

In this case the condition of existence is expressed by:

$$[A_nA_{n+1}/D]=(\xi,\delta)\ (\xi_1\geqq 1) \quad (3)$$

$\xi_1\geqq 1$ being a convenient design parameter.

b) POINTS $B_n$ $B_{n+1}$ (on the same helicoids reciprocally linked as per FIG. 4). Plane $\Sigma_B$, parallel to plane $\Sigma_A$ and passing through points $B_n$, $B_{n+1}$, determines two sections of the wires which may be considered elliptical, with centers in $B_n$ and $B_{n+1}$ and semiaxis parallel to $O_n$ $O_{n+1}$ given by:

$$bB=(d/2\cos B) \quad (4)$$

In this case the condition of existence is:

$$[B_nB_{n+1}/D]=(\xi_2\delta)\ (\xi_2\geqq 1/\cos B) \quad (5)$$

$\xi_2\geqq(1/\cos B)$ being a parametric condition (of tolerance, depending on step p).

On the other hand, the value of segment $B_n$ $B_{n+1}$, according to FIG. 4, depends on the pitch of the helicoids pursuant to:

$$B_nB_{n+1}=2tgB\times D/2\times\alpha \quad (6)$$

and since $\alpha$=arcs $(1-\xi,\delta)$, based on (5), it is inferred:

$$\eta=(1-A)/(\xi_{arcos\ A}) \quad (7)$$

with the positions:

$$A=1-\xi,\delta\ \zeta=\xi_1/\xi_2 \quad (8)$$

c) POINTS $C_n$ $C_{n+1}$ (on two contiguous helicoids but not mutually linked, as per FIG. 5). Planes $\Sigma_C$, parallel to the plane of axis $D_n$ y $D_{n+2}$ and which are determined (as per figure) by angles $D<X<\pi/2$, cut the axis of the metal strips in points $C_n$ y $C_{n+1}$. Segment $C_n$ $C_{n+2}$, projected on a parallel line to axis O is equal to:

$$z=tg\theta[(m\pi/4+x)-(m\pi/4-x)].D/2=\eta X.D \quad (9)$$

while its projection on a normal to the same O axis is:

$$x=(A.\sqrt{2}-senX).D \quad (10)$$

In the plane $\Sigma_C\equiv(x, z)$, which contains the sections of the metal strips, the relation with (10), (9) y (7), is as follows:

$$(x/z)=tg\beta \quad (11)$$

If we accept to consider on an elliptical basis the parts of the metal strip sections which may eventually intersect, calling $a_c$ y $b_c$ to its semiaxis, according to FIG. 5, the values of the coordinates $x_1$, $z_1$ which belong to these ellipses $$\frac{\chi_1^2}{a_c^2}+\frac{z_1^2}{b_c^2}=1$$

and to segment $C_n$ $C_{n+1}$ are:

$$\chi_1=\frac{b_c tg\beta}{\sqrt{1+\left(\frac{b_c}{a_c}\right)^2 tg^2\beta}} \qquad z_1=\frac{b_c}{\sqrt{1+\left(\frac{b_c}{a_c}\right)^2 tg^2\beta}} \quad (12)$$

thus since the condition of feasibility, in this case, is $$C_nC_{n+2}=z\cdot\sqrt{1+tg^2\beta},$$

the same is deducted with the expression:

$$\sqrt{1+tg^2\beta}\left[z-\frac{2b_c}{\sqrt{1+\left(\frac{b_c}{a_c}\right)^2 tg^2\beta}}\right]\geq 0 \quad (13)$$

which, pursuant to (11) corresponds to the elliptical form:

$$\left(\frac{z}{2b_c}\right)^2+\left(\frac{\chi}{2a_c}\right)^2\geq 1 \quad (14)$$

The determination of axis $b_c$ y $a_c$ (applying in both cases the same tolerance $\xi_2\geqq 1/\cos\theta$ which was accepted in (5) and considering the triangle $O_nP_nC_n$ of FIG. 5) provides the following results:

$$\begin{cases}\left(\frac{2b_c}{D}\right)=\xi_2\delta=\left(\frac{1-A}{\zeta}\right)\\ \left(\frac{2a_c}{D}\right)=\left[\sqrt{\left(\frac{1-A}{\zeta}\right)^2+2\left(\frac{1-A}{\zeta}\right)+sen^2X}-sen\,X\right]\end{cases} \quad (15)$$

noting that with: $X=\pi/2$ the following coincidence is deducted:

$$\frac{2b_c}{D}=\frac{2a_c}{D}=\zeta_2\delta$$

According to (14) and from (15), (10), (9) y (7), the following condition of feasibility, corresponding to points $C_n$ $C_{n+1}$:, results as follows:

$$\left(\frac{X}{\arccos A}\right)^2+\left[\frac{\left(A\sqrt{2}-sen\,X\right)}{\sqrt{\left(\frac{1-A}{\zeta}\right)^2+2\left(\frac{1-A}{\zeta}\right)+sen^2X}-sen\,X}\right]^2\geq 1 \tag{16}$$

Figure 6:
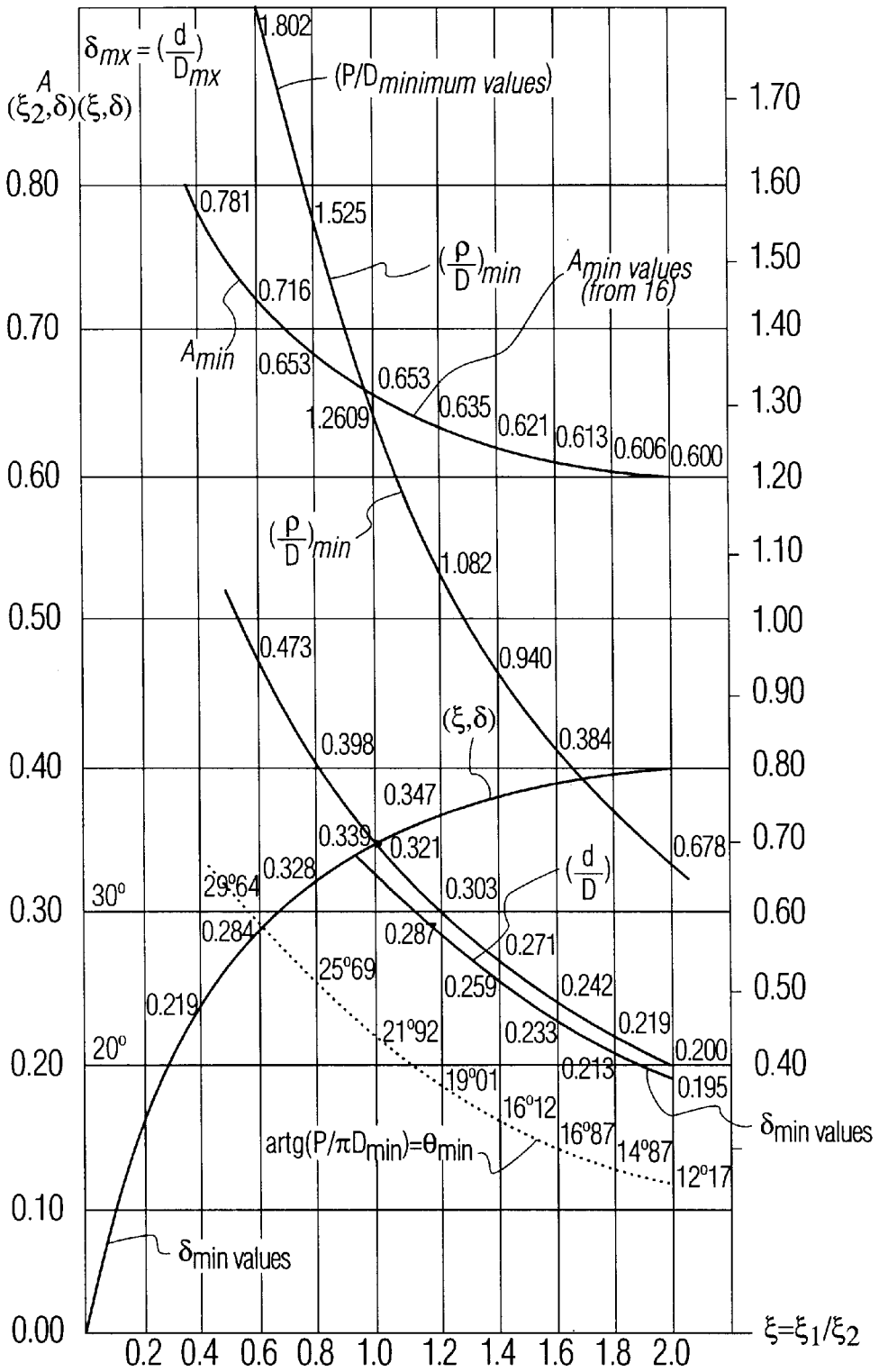

This condition must be met in all the interval $D<X<\pi/2$ and then it is determined—for each value of $\zeta$—the (minimum) value of A which makes it true, and this determines the (maximum) values which may be accepted in the parameters $(\xi_1\delta)=(1-A)$ and $(\xi_2\delta)=(1-A)/\zeta$ and the area of existence of the ratio $\delta=(d/D)$, shaded in the graphic of FIG. 6 and which is determined—according to (3) and (5)—with $\delta<(\xi_1\delta)<(\xi_2\delta)$ when $\zeta<1$ or with $\delta<(\xi_2\delta)<(\xi_1\delta)$, when $\zeta>1$.

d) Points $D_n$ $D_{n+2}$ (on two non contiguous helicoids). Plane $\Sigma_D$, passing through $O_n$ $O_{n+2}$ axis, contains the segment $D_n$ $D_{n+2}$, which two projections— normal and parallel to the axle $$On_{n+2}$$

—are equal to: $(D-2\xi_1 d)$ and $(\pi D/2tg\theta)$, *so then, keeping tolerance* $\xi_2$, in this case the feasibility is:

$$\left[\frac{D_nD_{n+2}}{D}\right]=\sqrt{(2A-1)^2+\left[\frac{\frac{\pi}{2}}{\arccos A}\left(\frac{1-A}{\zeta}\right)\right]^2}\geq\xi_2\delta=\left(\frac{1-A}{\zeta}\right) \tag{17}$$

that is to say:

$$\left(\frac{2A-1}{1-A}\right)^2\delta^2+\left(\frac{\frac{\pi}{2}}{\arccos A}\right)^2\geq 1 \tag{18}$$

a condition always met, since angle $\alpha=\arccos A$ (in FIG. 1) must always be less than $\pi/2$.

e) WEIGHT PARAMETER: $q/q_{on}$ on referred to the protected surface unit and to each of the n layers which form the mesh).

The weight of a coil of this mesh ($\gamma$ indicates the specific weight of the material used), considering the length which corresponds to a pitch p of the coils, is equal to:

$$Q_p=\left[\sqrt{(\pi D)^2+p^2}\right]\frac{\pi d^2}{4}\gamma \tag{19}$$

while the surface protected by each coil is:

$$S_p=(D-\xi_1 d)p \tag{20}$$

Consequently, with the symbols already defined, the following parameter is established:

$$q=(Q_p/S_p)q_{on}f_\zeta(A)\delta^2 \tag{21}$$

in short:

$$q_{on}=n\frac{\pi D}{4}\gamma \tag{22}$$

-continued $$f_\zeta(A)=\frac{1}{A}\sqrt{1+\left(\frac{\arccos A}{1-A}\right)^2\zeta^2}\left[\left(\frac{P}{\pi D}\right)=\frac{1-A}{\zeta\arccos A}\right]$$

Evidently, in the solution of (16), for each value of $\zeta=(\xi_1/\xi_2)$ a minimum value of A is determined ($A_{min}$ in FIG. 16), and in the design any A meeting the condition $A\geqq A_{min}$ may be adopted. However, calculating for each $\zeta$ and with $A>A_{min}(\zeta)$ different values of function $f_\zeta(A)$ (which in (21) establishes the weighted parameter of the mesh), it is verified—as it is observed in the numerical table of FIG. 7—that with $D.7<\zeta<2$ all the $f\zeta(A)$ present an almost minimum value when a constant value of $A=0.70>A_{min}(\zeta)$ is adopted. With this position [A=0.7 con $0.7<\zeta<2$] besides reducing to a maximum the mesh weight, the following functions are deduced from (21) and (22):

$$\left(\frac{q}{q_{on}}\right)=\frac{1}{0.70}\left(\sqrt{1+7.0317\cdot\zeta^2}\right)\cdot\delta^2\qquad\left(\frac{p}{D}\right)=\frac{1.1847}{\zeta} \tag{23}$$

$$\xi_1=\frac{0.30}{\delta}\qquad\xi_2=\frac{0.30}{(\zeta\delta)}$$

only based on both parameters $\delta$y $\zeta$.

With the corresponding graphical coordination of the five parameters ($d/D$, $q/q_{on}$, $p/d$, $\xi_1$ y $\zeta$) the space of existence of the meshes proposed (in FIG. 8) could be drawn, wherein each point P establishes a possible design, determined in all its geometric and weighted characteristics.

Figure 8:
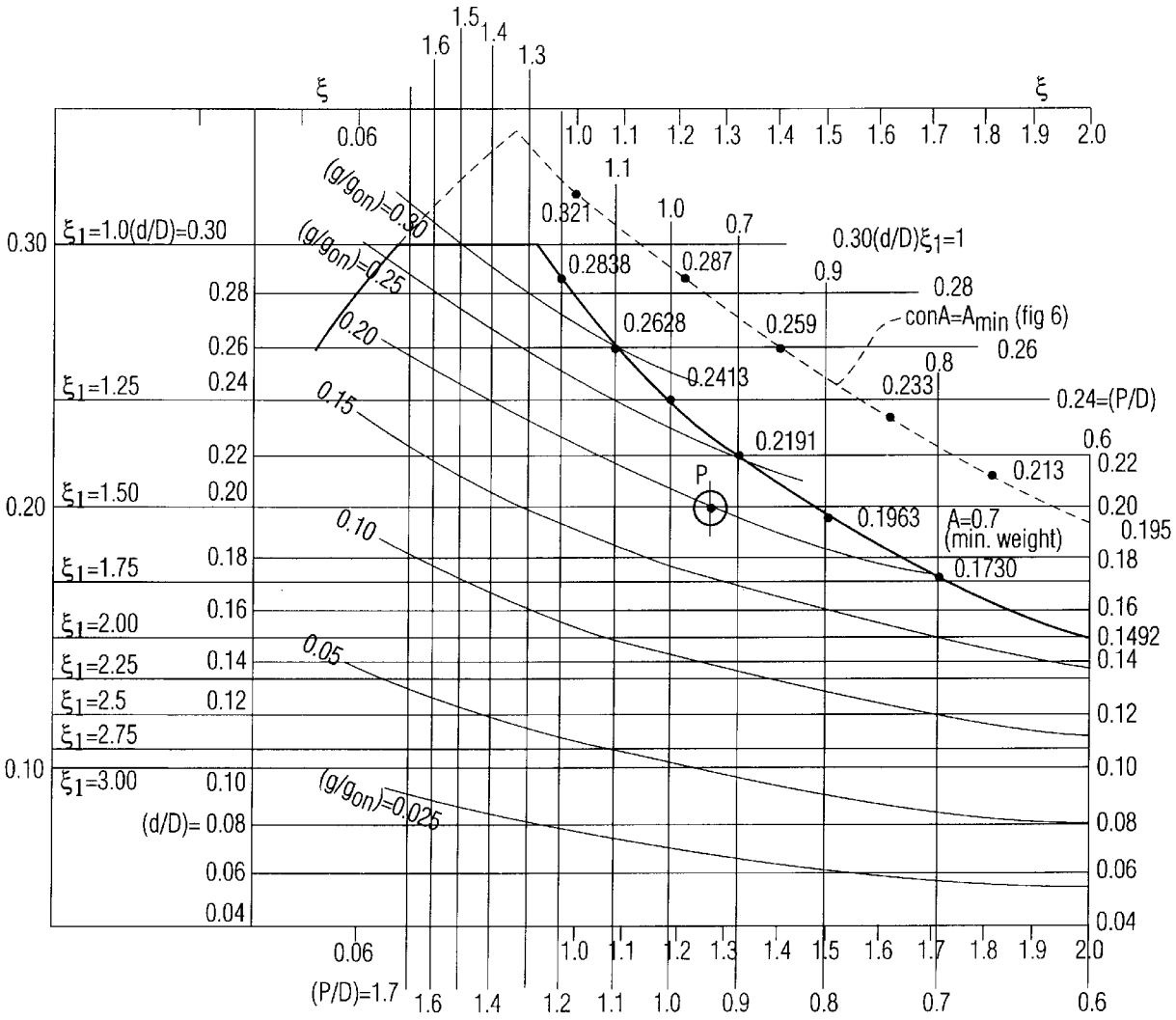

Comparing FIGS. 6 and 8, it is verified how the embodiment possibilities are reduced upon adopting the minimum weight condition of the meshes: the zone of the possible (and convenient) designs is not very extensive and this will facilitate the selection and the analysis of the designs which must be tested in order to determine their strength characteristics: e.g. it may be determined how the impact strength varies in different designs having the same weight (located on a curve of equal parameter) etc.

f) EXAMPLE OF APPLICATION: According to the design determined by point P located in the parametric space of FIG. 8, the following values are obtained:

$$d/D=0.20,\ p/D=0.94,\ q/q_{on}=0.20,\ \xi_1=1.5,\ \zeta=1.25$$

and if 4 layers are needed (n=4 ), the weight corresponding to one $dm^2$ of protected surface is equal to:

$$q=(Q_p/S_p)=(4\times\pi/4\times7.8\times D_{dm})\times0.20=4.90\ D$$

Upon selecting an 8 m/m diameter for the axle of the wires, the following results:

$$q=390\ gr/dm^2$$

with a wire diameter of 1.6 m/m, a pitch of 7.5 m/m and a lining between helicoids of 1.5×1.6=2.4 m/m: this solution is very similar to the one carried out in the section of the mesh analysed.

EXAMPLES OF APPLICATION

Example 1

If it is desired to form a structure able to absorb efficiently physical stress of mechanical nature using the procedure invented herein, the following shall be done:

1) Obtain a metallic filament of a predetermined thickness, which may be made of steel, aluminium, fibers, titanium or other composite materials.

2) Establish the conformation characteristics of the helicoids which will form the metal strips to be used, indicating:

a) according to the thickness of the filament, the "pitch" or space between each succesive helicoid must be found.

b) the inner diameter of each helicoid.

c) the outer diameter of each helicoid.

3) Once the helical metal strips are formed, pursuant to the construction and conformation characteristics to be established, the metal strips are stringed, entangling the same to each other, pursuant to orientations and directions predetermined according to the calculation, wherein two layers formed with steel metal strips may be replaced with three layers formed with carbon fiber metal strips; three aluminium layers, all of them interlinked to each other to form a single structure, which is flexible, highly resistant and with great capacity to absorb punctual impacts.

Example 2

If the construction of a structure which will conform sheets or plates capable of absorbing high temperatures is desired, the filament diameter or thickness may be of about 1 mm, and the helical metal strips made from materials such as titanium, copper or aluminium combined with other materials which utilize synthetic fibers or composite materials. According to the thickness of the indicated filament, the diameter of helicoids, the pitch and the amount of metal strips required is established, combining, for example, three layers of filaments composed of carbon fibers or composite materials and three layers of filaments composed of copper; thus obtaining a structure capable of resisting and preventing high temperatures from passing through its body.

Example 3

Using steel, aluminium and titanium filaments, in combination with others made of fibers such as those usually designated "Dinema", "Kevlar" or "Tuaron" fibers, having an 0.50 mm thickness, and establishing the helicoid diameters and pitch which may allow to combine from four to six layers sandwiched one to the other, structures capable of absorbing and preventing the passage of sound waves may be constructed, and forming with such structures soundproof acoustic sheets, or else motor vehicle silencers or silencers for guns, etc.

What is claimed is:

1. A procedure to construct highly resistant structures with ability to absorb energy by the interlinking of layers formed with longitudinal helical metal strips, wherein said structure comprises the steps of forming helical metal strips, and the filament thickness as well as the span, pitch, external and internal diameter of each helical sphere is predetermined; the step of entangling to each other said helical metal strips by stringing them together, interposing the helical coils of each metal strip with the helical coils of adjacent metal strips, which is produced by means of a forward longitudinal movement of advance, of each metal strip, with a simultaneous movement which is rotary respect to its own axle, about at least another helical strip which remains static and receptive; conforming sets of entangled, parallel metal strips and coplanar to each other, thereby defining layers; and, entangling adjacent layers stringing together the metal strips of each layer.

2. A procedure to construct a structure according to claim 1, wherein the helicoid is formed from a continuous filiform element.

3. A procedure to construct a structure, according to claim 1, wherein the helicoid is obtained by injection into conformation dies.

4. A procedure to construct a structure, according to claim 1, wherein the helical metal strip includes fibers.

5. A procedure to construct a structure, according to claim 1, wherein the helical metal strip includes composite materials.

6. A procedure to construct a structure, according to claim 1, wherein the helical coils of the metal strips are circular in shape.

7. A procedure to construct a structure, according to claim 1, wherein the helical coils of the metal strips are ellipsoidal in shape.

8. A procedure to construct a structure, according to claim 1, wherein the helical coils of the metal strips are polygonal in shape.

9. A procedure to construct a structure, according to claim 1, wherein the constitutive material of the entangled helical metal strips which are disposed in a parallel and coplanar basis respect to each other, forming a layer, is different from that of the metal strips of the associated layers.

10. A procedure to construct a structure, according to claim 1, wherein the helical metal strips during the process of entanglement, follow a perpendicular direction, respect the orientation of the metal strips belonging to the previous layer, to which they are being stinged.

11. A procedure to construct a structure, according to claim 1, wherein the helical metal strips during the process of entanglement, follow a skewed direction, respect the orientation of the metal strips belonging to the previous layer to which they are being stinged.

12. A structure composed of longitudinal helical metal strips, according to claim 1, which is formed by a plurality of layers entangled to each other, which are formed by longitudinal helical metal strips, being the volume of the gaps which define the porosity thereof, at least equal to the thickness of the filament conforming each metal strip.

13. A structure composed of longitudinal helical metal strips, according to claim 1, wherein the helical metal strip is made of fibers.

14. A structure composed of longitudinal helical metal strips, according to claim 1, wherein the helical metal strip is made of steel.

15. A structure composed of longitudinal helical metal strips, according to claim 1, wherein the helical metal strip is made of aluminium.

16. A structure composed of longitudinal helical metal strips, according to claim 1, wherein the helical metal strip is made of copper.

17. A structure composed of longitudinal helical metal strips, according to claim 1, wherein the helical metal strip is made of titanium.

18. A structure composed of longitudinal helical metal strips, according to claim 1, wherein the constitutive material of the entangled helical metal strips is the same.

19. A structure composed of longitudinal helical metal strips, according to claim 1, wherein the constitutive material of the entangled helical metal strips is different.

* * * * *